United States Patent [19]

O'Brian et al.

[11] 4,159,112

[45] Jun. 26, 1979

[54] FOLDING STRUCTURE USED AS A CLIMBER FOR PRESCHOOL CHILDREN

[76] Inventors: Edward D. O'Brian, 910 Iroquois, Anaheim, Calif. 92801; William M. Plachy, 3353 San Marcos Blvd., San Marcos, Calif. 92069

[21] Appl. No.: 786,831

[22] Filed: Apr. 12, 1977

[51] Int. Cl.[2] ..... A63B 17/02

[52] U.S. Cl. ..... 272/113; 46/31; 272/56.5 R

[58] Field of Search ..... 272/21, 25, 112, 113; 46/29, 31, 12, 1 R; 5/100, 99 R, 99 B, 99 C; 256/73, 26; 35/72; 116/63 P, 63 C, 63 T; 40/125 H, 125 N; 52/648

[56] References Cited

U.S. PATENT DOCUMENTS

| | | | |
|---|---|---|---|
| D. 224,796 | 9/1972 | Price et al. | 272/113 X |
| 1,479,147 | 1/1924 | Markworth | 35/72 |
| 2,629,110 | 2/1953 | Fournier | 5/99 C |
| 2,754,550 | 7/1956 | Johnson et al. | 46/12 X |
| 3,693,283 | 9/1972 | Marcus | 46/1 R X |
| 4,072,295 | 2/1978 | Roberts | 256/26 |

*Primary Examiner*—Richard C. Pinkham
*Assistant Examiner*—William R. Browne
*Attorney, Agent, or Firm*—Edward D. O'Brian

[57] ABSTRACT

A folding structure useful as a "climber" or climbing type play equipment for children can be constructed so as to utilize an odd number of sides located in side edge to side edge relation. One of the sides used can be referred to as an end side; the remainder of the sides consist of an even number of pairs of sides, the sides on each of the pairs having identical external dimensions. Hinges are utilized to connect the adjacent edges of all of the sides to one another so as to form a continuous "band" type structure. The sides are of such external dimensions as to permit them to be folded between an open position in which all of the sides define a hollow structure and a collapsed position in which the sides of the pairs of sides extend adjacent to one another in a stacked relationship and in which the end side extends along side edges of the sides as they are located in this stacked configuration.

10 Claims, 9 Drawing Figures

FOLDING STRUCTURE USED AS A CLIMBER FOR PRESCHOOL CHILDREN

BACKGROUND OF THE INVENTION

The invention set forth in this specification pertains to new and improved folding structures. More specifically the invention is directed toward folding structures which can be utilized as "climbers" or climbing type play equipment for children. It is considered, however, that the folding structures of the present invention can be adapted for a great many other different uses.

Virtually every children's playground includes one or more different items of climbing type play equipment or climbers. These devices are highly utilitarian for play purposes. Unfortunately many preschool child care facilities and many day-care child care facilities are unable to have climbers for use by children because of the amount of space occupied by known climbers. As a result of a recognition of this it is considered that there is a need for folding structures useful as climbers which are of such a character that they may be easily manipulated between an open position in which they are capable of serving their intended purpose, and a folded configuration in which they can be easily moved to an out-of-the-way location for storage.

SUMMARY OF THE INVENTION

A broad object of the present invention is to fulfill this need. More specifically the invention is intended to provide new and improved folding structures which can be manipulated between an open or expanded position as indicated in the preceding in which they can be utilized for their intended purpose and a folded or collapsed configuration in which they can be easily moved and stored. Other related broad objects of the present invention are to provide folding structures as indicated in the preceding which may be constructed with minimal difficulty, which are comparatively inexpensive, which are comparatively satisfactory from structural viewpoints, and which may be easily and conveniently manipulated between positions as noted.

The invention is specifically directed toward folding structures as noted in the preceding paragraph which are especially adapted for use by children as climbers or climbing type play equipment. This is not intended to imply that a folding structure of the invention when used as a climber is only useful in connection with climbing activities. The climbers of the present invention are considered to be capable of being utilized by children in a wide variety of different manners in accordance with the expansiveness of the imaginations of the children using these items. They can be utilized as simulated forts, as play dwellings and the like. Through minor modifications these devices can be utilized as slides.

In accordance with this invention the various objectives indicated in the preceding are achieved by providing in a folding structure having a plurality of sides located in side-edge-to-side-edge relationship and a plurality of hinge means permitting said sides to be folded relative to one another the improvement comprising: said structure having an odd number of sides, one of said sides being a connecting side, the remainder of said sides consisting of an even number of pairs of sides, the sides in each of said pairs having identical external dimensions, said hinge means securing adjacent side edges of all of said sides to one another, said sides being of such external dimensions as to permit said sides to be folded relative to one another between an open position in which all of said sides define a hollow structure and a collapsed position in which said sides of said pairs extend adjacent to one another in stacked relationship and in which said connecting side extends between the side edges of the sides of one of said pairs.

BRIEF DESCRIPTION OF THE DRAWING

Because of the nature of the invention it is best more fully explained with reference to the accompanying drawing in which.

Figure 1:
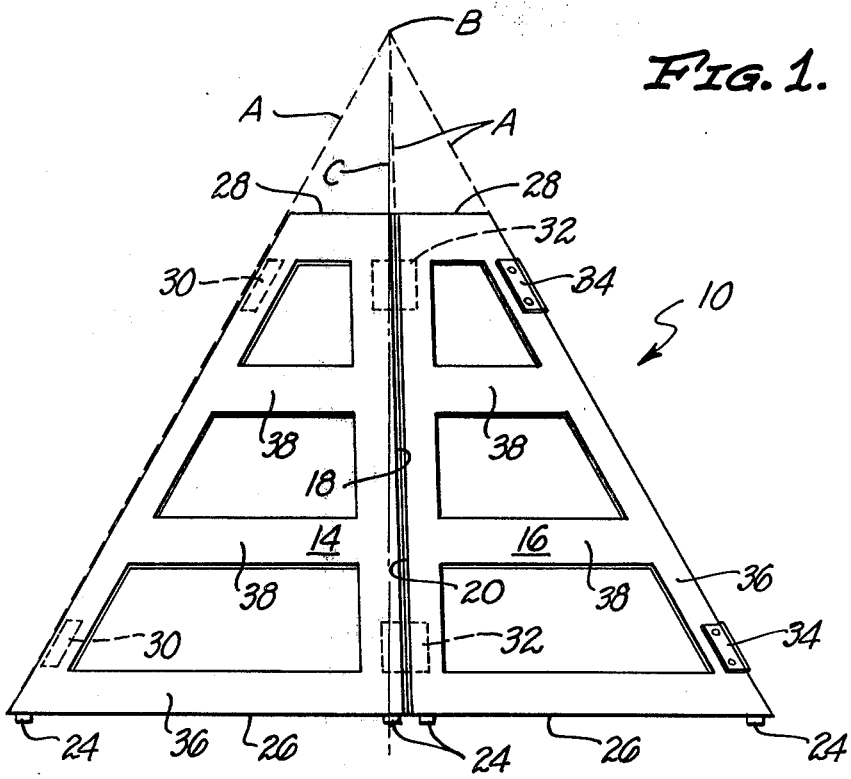
FIG. 1 is a side elevational view of a presently preferred folding structure useful as a climber in accordance with this invention.

The invention set forth in this specification employs certain operative concepts or principles as are set forth and defined in the appended claims forming a part of this disclosure. Those skilled in the field of the design and construction of folding devices will realize that these concepts or principles can be easily employed in a wide variety of differently appearing and somewhat differently constructed folding structures through the use or exercise of routine engineering skill.

DETAILED DESCRIPTION

In FIGS. 1 to 4 of the drawing there is shown a climbing structure or climber 10 in accordance with this invention which includes a connecting side 12, two other sides 14 of identical external dimension and two further sides 16 which are also of identical external dimension. All of these sides 12, 14 and 16 are of a trapezoidal shape. The sides 14 are constructed so as to have side edges 18 which are spaced further from one another than the side edges 20 of the further side 16. The connecting side 12 has side edges 22 which are spaced considerably closer to one another than the side edges 20 so as to achieve the folding action hereinafter indicated. Preferably small, conventional furniture support type legs 24 are located on the lower edges 26 of the sides 12, 14 and 16. In the precise structure 10 illustrated the sides 12, 14 and 16 all have upper edges 28.

Figure 2:
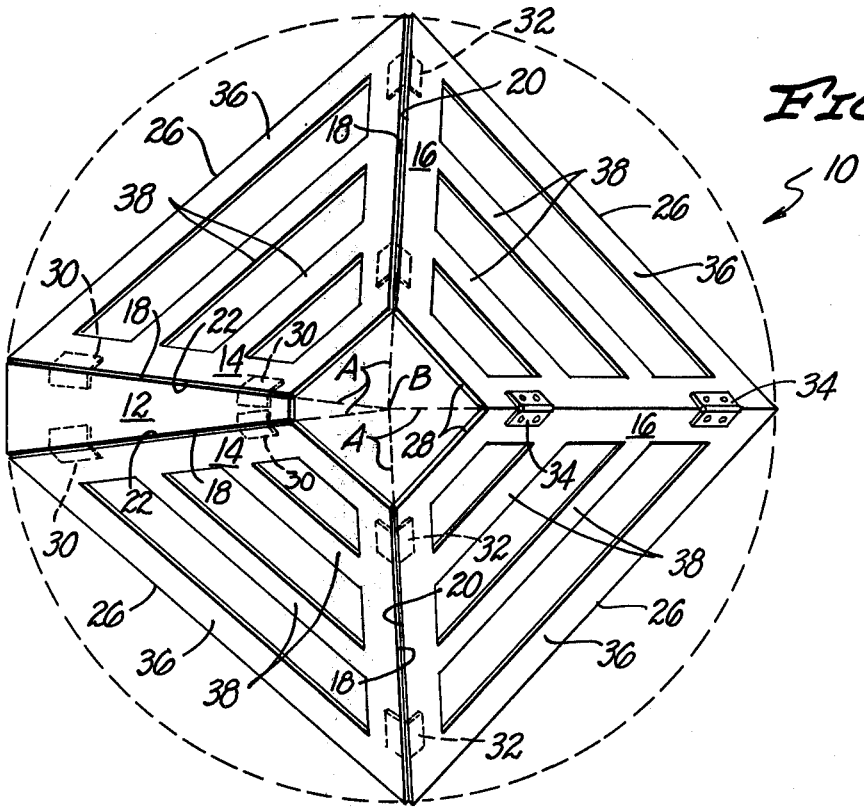
FIG. 2 is a top plan view of the climber shown in FIG. 1.

It will be apparent from FIGS. 1 and 2 of the drawing that the sides 12, 14 and 16 are located relative to one another so that each of the side edges 22 of the connecting side 12 is located adjacent to a side edge 18 of a side 14 and so that a side edge 18 of each of the sides 14 is located adjacent to a side edge 20 of a side 16 and so that these sides 16 are located so as to have adjacent side edges 20. A set of hinges 30 which may be referred to as a hinge means (not separately numbered) is utilized to connect each of the side edges 22 of the connecting side 12 to an adjacent side edge 18 of a side 14. A set of hinges 32 which may also be referred to as a hinge means (not separately numbered) is also utilized to connect a side edge 18 of each of the sides 14 to a side edge 22 of a further side 16. A third set of hinges 34 which may also be referred to as a hinge means is used to connect the adjacent side edges 20 of the sides 16.

The hinges 30 are disposed so as to permit the sides 14 to swing relative to the connecting side 12 toward one another. The hinges 32 are disposed so as to permit the sides 16 to fold inwardly between the sides 14 so that each side 16 is substantially parallel and in face-to-face relationship with a side 14. The hinges 34 are disposed so as to permit the sides 16 to fold about their adjacent side edges 20 in what may be referred to as back-to-back relationship between the sides 14. In order to accomplish this method of folding it is necessary that the hinges 30, 32 and 34 be arranged in such a manner that the axes of these hinges as indicated by the dotted lines marked A meet in a common point marked by the letter B. In the drawing these axes A are indicated by dotted lines since they are not an actual part of the structure 10. Although it is considered desirable that all of the axes A meet at exactly the common point B a structure such as the structure 10 will fold satisfactorily if they do not meet in exactly a common point when hinges are used which are relatively "sloppy" in the sense that the pivot pins (not separately shown) within these hinges are relatively loose.

Figure 3:
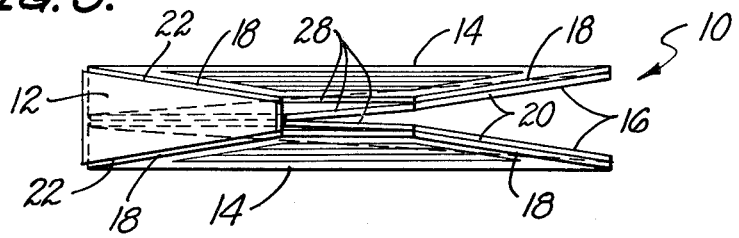
FIG. 3 is a top plan view showing this climber in a folded or collapsed position.

Normally the structure 10 as illustrated in FIGS. 1, 2 and 3 of the drawing is suitable for use without any additions being made to this structure. When it is an open or expanded configuration as illustrated in FIGS. 1 and 2 it defines essentially a hollow, endless band type structure which can be easily employed for play purposes and which readily adapts to minor variations in the level of a supporting surface (not shown). Because the sides 12, 14 and 16 of the structure 10 slope inwardly—i.e., toward one another—the structure 10 is of such a nature that it can only be tipped over by children during play with relative difficulty.

In order to heighten the play value of the structure 10 the sides 12, 14 and 16 may be modified in quite a number of ways. It is considered preferable to make these sides 12, 14 and 16 as essentially a ladder so that each consists of a framework 36 containing various horizontally extending slats 38 which may be used by children in climbing upon the structure 10. Such a complete structure 10 is capable of being utilized as a playhouse or the like by the simple expedient of draping a blanket over it. If desired the sides 12, 14 and 16 may consist of a partial framework and/or panels with or without holes of various sizes cut in them.

Figure 4:
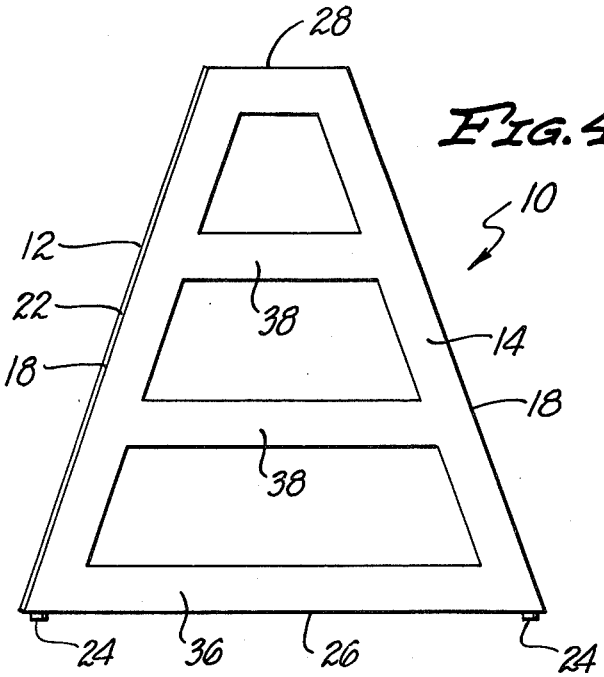
FIG. 4 is a side elevational view showing this climber in a folded or collapsed position.

One significant advantage of the structure 10 lies in the manner in which the sides 14 and 16 may be folded relative to the sides 12 in a stacked relationship as indicated in FIGS. 3 and 4 of the drawings. When the structure 10 is folded to a collapsed position or configuration as indicated in FIGS. 3 and 4 it can be moved from one location to another for storage purposes. As a consequence of this the structure 10 does not have to be a permanent structure and can be set up in an open position in a day-care center or the like where space is limited only when it is desired to utilize this structure 10.

Figure 5:
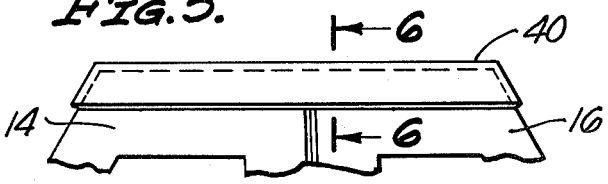
FIG. 5 is a partial side elevational view corresponding to FIG. 1 showing a retaining cap utilized with the climber illustrated in the preceding figure.
Figure 6:
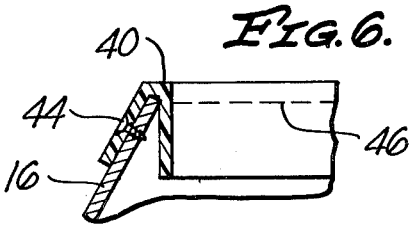
FIG. 6 is a partial cross-sectional view taken at line 6—6 of FIG. 5.

Although normally it is considered that it will not be necessary to secure the sides 12, 14 and 16 in the structure 10 against relative movement when this structure 10 is in an open position or expanded configuration as shown in FIGS. 1 and 2, it is, of course, possible to secure this structure 10 in such a position through the use of appropriate conventional fasteners (not shown) extending between the sides 12, 14 and 16. It is, however, preferred to utilize sort of a cap or cap like frame 40 as indicated in FIGS. 5 and 6 of the drawing when it is considered advisable to secure the sides 12, 14 and 16 against motion in an open position. This frame 40 includes a downwardly directed groove 42 which is adapted to fit over the upper edges 28 of all of the sides 12, 14 and 16 and to engage these sides 12, 14 and 16 as indicated in FIG. 6 so as to secure them against relative movement.

The frame 40 may be held in place by gravity. A single fastener such as a screw 44 is normally adequate to secure the frame 40 in place. Obviously this frame 40 can, if desired, be provided with a top 46 as indicated in dotted lines in FIG. 6. This is not considered to be overly desirable because children may tend to stand on this top.

Figure 7:
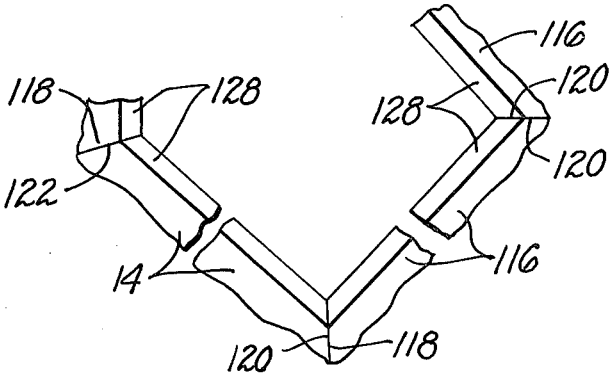
FIG. 7 is a partial top plan view corresponding to FIG. 2 at an enlarged scale indicating a modification which may be made in a climber in accordance with this invention.

It is, of course, possible to utilize other expedients in order to secure the sides 12, 14 and 16 to any extent which may be considered desirable. As an example of this a part of a modified structure 100 is indicated in FIG. 7 of the drawing. For convenience and in the interest of brevity those parts of the structure 100 which are substantially the same as the corresponding parts of the structure 10 are not separately described herein and are designated by the numerals previously used in connection with such parts preceded by the numeral 1.

The structure 100 differs from the structure 10 solely in that the edges 118, 120 and 122 are beveled at appropriate angles so that they abut against one another to limit the movement of the sides 112, 114 and 116 so that these sides 112, 114 and 116 can not be pivoted beyond or past an open or expanded configuration. The use of beveled side edges 118, 120 and 122 is, however, advantageous in case the structure 100 is apt to be utilized as a completely enclosed structure for any of a number of different purposes.

Figure 8:
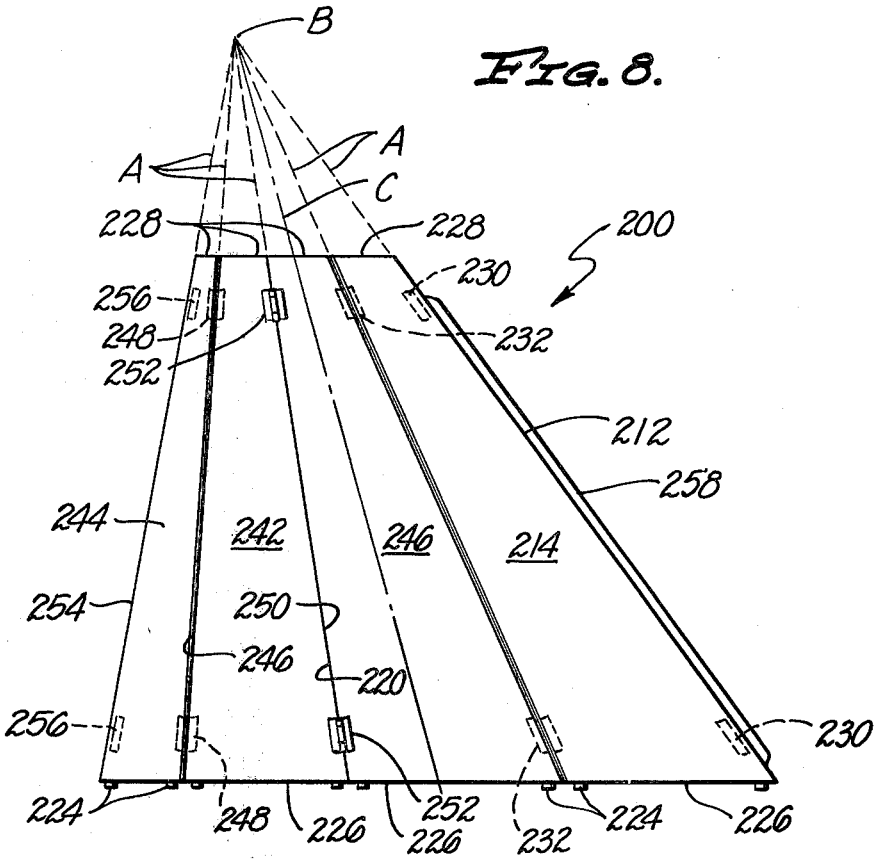
FIG. 8 is a side elevational view of a modified climber in accordance with this invention.
Figure 9:
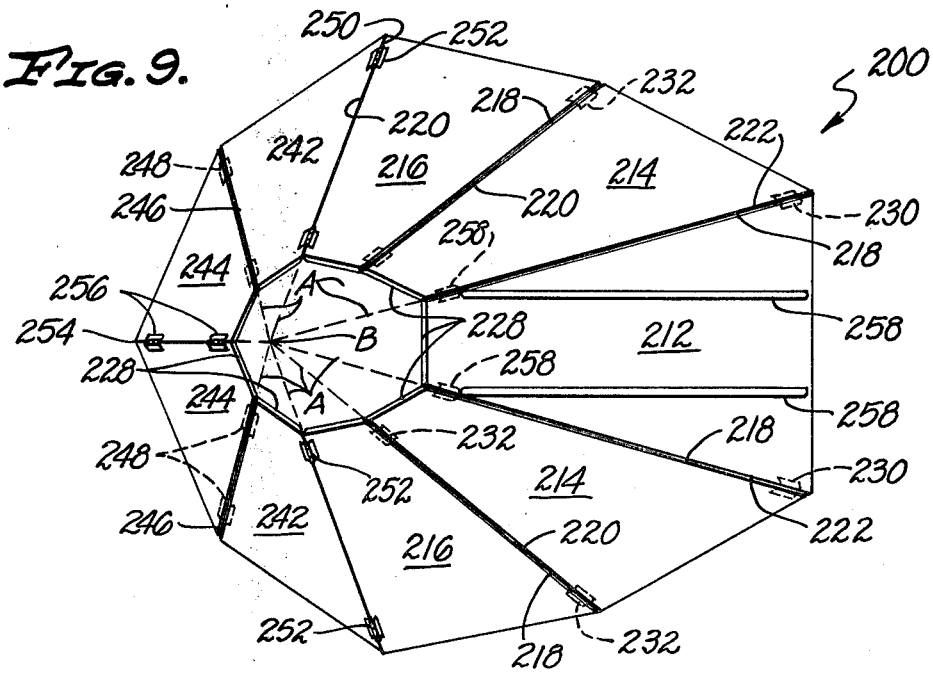
FIG. 9 is a top plan view of the climber shown in FIG. 8.

In FIGS. 8 and 9 of the drawing there is shown a further modified folding structure 200 which is also quite closely related to the structure 10. Again, for convenience and in the interest of brevity those parts of the structure 200 which are substantially the same as corresponding parts of the structure 10 are not separately described herein and are designated by the numerals previously used in connection with such parts preceded by the numeral 2.

One of the differences between the structures 10 and 200 relates to what is essentially a minor difference in geometry when these structures are in an open or expanded position. In such a position of the structure 10 the axes A of the hinges 30, 32 and 34 lie within what may be referred to as the locus of an imaginary right circular cone (not shown) having its apex at the point B. In such a position of the structure 10 the upper and lower edges 28 and 26 are disposed substantially as if they were located in imaginary planes (not shown) located parallel to one another and perpendicular to the axis C of such a cone as indicated by dotted lines in FIG. 1. As opposed to this the structure 200 is of such a character that the upper and lower edges 228 and 226 of the various sides 212, 214 and 216 are located substantially in imaginary parallel planes (not shown) which are located other than perpendicular to the axis C. The axes A of the various hinges 230, 232 and 234 still meet at a common point B corresponding to the apex of such an imaginary cone.

The structure 200 also differs from the structure 10 in that it minimizes the dimensions of the sides 214 and 216 necessary for the structure 200 to be capable of being folded into a compact configuration. This is accomplished by utilizing in addition to the pair of the sides 214 and the pair of the sides 216 a pair of further sides 242 and another pair of sides 244. These sides 242 and 244 have adjacent side edges 246 which are joined by still other hinges or hinge means 248. These sides 242 also have other side edges 250 which are joined to side edges 220 of the sides 216 by other hinges or hinge means 252. The sides 244 also have adjacent edges 254 joined by hinges or hinge means 256.

The sides 214, 216, 242 and 244 may be folded in a back and forth, pleated manner when the structure 200 is folded to a collapsed position or configuration. This use of the four pairs of sides 214, 216, 242 and 244 is considered preferable in the structure 200 over the use of only two pairs of sides 214 and 216 because of the preferred size of the side 212. The latter is related to the subsequently explained use of the side 212. The axes A of these hinges 248 and 250 must meet at the point B if the structure 200 is to fold. Obviously the sides 214, 216, 242, and 244 are quatralateral but are not conventional trapezoids in the structure 200. It is possible to minimize the size of the sides 14 and 16 in the structure 10 or of the sides 214, 216, 242 and 244 in the structure 200 by utilizing even numbers of pairs of such sides to any desired extent in connection with a connecting side 12 or 212. From the point of view of practicality it is considered desirable to minimize the numbers of sides employed to as great a degree as reasonably possible.

Because of the "unbalanced" shape of the structure 200 the connecting side 212 is comparatively long and has a comparatively limited slope relative to a supporting surface when the structure 200 is in an open or expanded configuration. As a consequence of this it is possible to utilize the connecting side 212 as a child's slide. When this is done it is preferred to locate on the connecting side 212 small hand rails 258 which may be used to control the path a child will follow in moving down the side 212. Because these rails 258 project outwardly from the side 212 they will not interfere with the folding action achieved. However, when the side 212 is used as a slide this side 212 will have to be of adequate dimension between its side edges 222 so as to accommodate a child.

Although it would be possible to make a structure corresponding to the structure 200 with a side 214 serving as a slide with the rails 254 in place on such a side 214 without interfering with the folding action, this is not considered desirable because of the comparative width of the side 214. The construction of the structure 200 so that a side 216 slopes gently to serve as a slide is also not considered desirable because of the rails 242 tending to interfere with the folding action. However, utilitarian folding structures 200 can be made in either of these manners and in some ways they may be somewhat more desirable than the precise structure 200 illustrated.

We claim:

1. A folding structure having a plurality of sides located in side-edge-to-side-edge relationship and a plurality of hinge means permitting said sides to be folded relative to one another in which the improvement comprises:

said structure having an odd number of sides, one of said sides being a connecting side, the remainder of said sides consisting of an even number of pairs of sides, the sides in each of said pairs having identical external dimension, the sides of said pairs of sides differing in dimension, said sides of said pairs of sides being located in two series of sides of decreasing dimension in which a side edge of each of said pairs of sides is located adjacent to a side edge of a side of the next pair of sides, each of the side edges of said connecting side being located adjacent to a side edge of a side of the largest of said pair of sides, side edges of each of the sides of the smallest of said pairs of sides being located adjacent to one another, each of said hinge means connecting a side edge of one of said sides to the side edge of another of said sides so as to form an endless band which is capable of being folded, said sides being of such external dimension as to permit said sides to be folded relative to one another between an open position in which all of said sides define a hollow structure and a collapsed position in which said sides of said pairs extend adjacent to one another in stacked relationship and in which said connecting side extends between the side edges of the sides of one of said pairs.

2. A folding structure as claimed in claim 1 in which: said hinge means securing said sides have axes which intersect at a common point.

3. A folding structure as claimed in claim 2 in which: all of said sides have a trapezoidal shape.

4. A folding structure as claimed in claim 2 in which: there are a total of five of said sides, the sides of said pair of sides which are connected to said connecting side being larger than the sides of the other of said pair of sides.

5. A folding structure as claimed in claim 2 in which: said sides of said pairs of sides are of a quatralateral, non-trapezoidal shape.

6. A folding structure as claimed in claim 5 in which: there are nine of said sides.

7. A folding structure as claimed in claim 1 in which: said hinge means securing said sides have axes which intersect at a common point, all of said sides have a trapezoidal shape, there are a total of five of said sides, the sides of said pair of sides which are connected to said connecting side being larger than the sides of the other of said pair of sides.

8. A folding structure as claimed in claim 7 including: means for holding said sides against relative movement when said structure is in said open position.

9. A folding structure as claimed in claim 1 in which: there are nine of said sides, the sides of said pair of sides which are connected to said connecting side being larger than the sides of the other of said pairs of sides, means for holding said sides against relative movement when said structure is in said open position.

10. A folding structure as claimed in claim 1 including:

means for holding said sides against relative movement when said structure is in said open position.

* * * * *